US011643844B2

(12) United States Patent
Megidesh et al.

(10) Patent No.: US 11,643,844 B2
(45) Date of Patent: May 9, 2023

(54) NOVO LOCK

(71) Applicant: PEGASUS INTEGRATED SOLUTIONS LTD., Kfar Menachem (IL)

(72) Inventors: Yaacov Megidesh, Kfar Menachem (IL); Eyal Artsiely, Moshav Yafit (IL)

(73) Assignee: PEGASUS INTEGRATED SOLUTIONS LTD., Kfar Menachem (IL)

( * ) Notice: Subject to any disclaimer, the term of this patent is extended or adjusted under 35 U.S.C. 154(b) by 307 days.

(21) Appl. No.: 16/955,604

(22) PCT Filed: Dec. 18, 2018

(86) PCT No.: PCT/IL2018/051368
§ 371 (c)(1),
(2) Date: Jun. 18, 2020

(87) PCT Pub. No.: WO2019/123454
PCT Pub. Date: Jun. 27, 2019

(65) Prior Publication Data

US 2021/0087855 A1 Mar. 25, 2021

(30) Foreign Application Priority Data

Dec. 18, 2017 (IT) ..... 102017000145948

(51) Int. Cl.

| | |
|---|---|
| ***E05B 47/06*** | (2006.01) |
| ***E05B 15/02*** | (2006.01) |
| ***E05B 53/00*** | (2006.01) |
| ***E05B 65/00*** | (2006.01) |
| ***E05B 65/06*** | (2006.01) |

(Continued)

(52) U.S. Cl.
CPC ..... *E05B 47/06* (2013.01); *E05B 15/0205* (2013.01); *E05B 53/003* (2013.01); *E05B 65/0071* (2013.01); *E05B 65/06* (2013.01); *E05B 65/0858* (2013.01); *E05B 83/42* (2013.01); *E05C 3/34* (2013.01); *E05C 3/40* (2013.01); *E05B 83/12* (2013.01); *E05B 2015/0235* (2013.01)

(58) Field of Classification Search
CPC .... E05B 47/06; E05B 15/0205; E05B 53/003; E05B 65/0071; E05B 65/06; E05B 65/0858; E05B 83/42; E05B 83/12; E05B 2015/0235; E05C 3/34; E05C 3/40; E05Y 2900/132; E05Y 2900/148; E05Y 2900/531
See application file for complete search history.

(56) References Cited

U.S. PATENT DOCUMENTS

| | | | |
|---|---|---|---|
| 975,037 | A | 11/1910 | Hettwer |
| 2,151,181 | A | 3/1939 | Appell |

(Continued)

FOREIGN PATENT DOCUMENTS

| | | | |
|---|---|---|---|
| DE | 3707324 | C2 | 5/1991 |
| DE | 10048278 | A1 | 4/2002 |

*Primary Examiner* — Mark A Williams
(74) *Attorney, Agent, or Firm* — Browdy and Neimark, P.L.L.C.

(57) ABSTRACT

The present invention provides a resistant lock for locking doors, having a locking mechanism that enable locking the door in any direction without any modification or adjustment thereof, and that provide improved security.

10 Claims, 23 Drawing Sheets

(51) Int. Cl.

| | |
|---|---|
| ***E05B 65/08*** | (2006.01) |
| ***E05B 83/42*** | (2014.01) |
| ***E05C 3/34*** | (2006.01) |
| ***E05C 3/40*** | (2006.01) |
| *E05B 83/12* | (2014.01) |

(56) References Cited

U.S. PATENT DOCUMENTS 3,012,811 A * 12/1961 Sandrock ..... G21C 19/105 976/DIG. 251
3,020,084 A 2/1962 Sylvester
3,515,421 A 6/1970 Poe et al.
3,561,802 A 2/1971 Brockway
3,875,594 A 4/1975 Swanson
4,482,175 A * 11/1984 Sugie ..... E05C 19/022 292/45
4,792,165 A 12/1988 Nishimura
4,836,707 A * 6/1989 Myers ..... B25J 15/028 403/328
5,192,096 A * 3/1993 Weinerman ..... E05C 3/34 70/130
5,209,530 A * 5/1993 Koi ..... E05C 3/165 292/337
5,297,840 A 3/1994 Size et al.
5,312,147 A * 5/1994 Rudoy ..... B66C 1/66 294/82.32
5,915,766 A * 6/1999 Baumeister ..... B04B 7/06 292/201
5,984,381 A * 11/1999 Yamagishi ..... E05C 19/022 292/45
5,997,056 A * 12/1999 Yamagishi ..... E05C 19/022 292/6
7,021,684 B2 * 4/2006 Orbeta ..... E05B 47/0046 292/201
7,165,790 B2 * 1/2007 Bella ..... E05C 19/022 292/6
7,393,026 B2 * 7/2008 Ikeda ..... E05C 19/02 292/341.15
7,530,613 B2 * 5/2009 Kim ..... F42B 3/006 92/24
8,146,864 B2 4/2012 Köppel et al.

* cited by examiner

NOVO LOCK

FIELD OF THE INVENTION

The present invention relates in general to locks and methods for locking doors. Specifically, the present invention relates to uniquely designed lock and locking mechanism that enable locking of both sliding- and swing-doors without any modification or adjustment thereof.

BACKGROUND

Locking doors and windows is the first precaution measure against unauthorized entry. Numerous locks and locking mechanisms have been developed for various doors and windows constellations.

For example, trucks and other vehicles that are equipped with a pair of swing doors, each pivoted at a rear side corner of the vehicle's body, and pivoted together in a common plane to close the rear entry of the door, use a dedicated lock to hold the doors closed. Known pivoted latches include a vertical rotary shift with a latch tongue that fits into a latch pocket on the truck/car bed, wherein the shafts are locked in an engaged position to keep the door secured when closed. This configuration has some drawbacks, such as inherent interference with some lift means at the rear of the truck, and inadequacy to certain types of doors.

Locks of leaf doors are usually provided with a spring latch and a sliding latch protrude from the door's edge, wherein the spring latch can retract with the movement of a handle or a key in the actuation cylinder. In double-leaf doors, the secondary leaf can be locked manually or opened with a respective handle, which is not operational when the main leaf is closed in order to prevent forced entry. In latch-and-bolt locks, e.g. as in double-leaf doors, actuation of the bolt into the closure position can occur only after the latch has already engaged a corresponding selvage, especially after closing a door: the door is first set ajar until the latch snaps into position for engaging the corresponding selvage and then the bolt is actuated into the closed position, e.g. with a key or automatically.

Another type of door is a sliding door. Sliding doors are usually guided via lateral guide rails at the perimeter of the opening. The sliding door are usually moved manually and needed to be locked when in closed position. Usually, at least two door locks are connected to the door structure, and when closing such doors, the respective door must be held tight when locking in the closed position. In the event that the door has not been pushed closed to a sufficient extent, it can happen that the one or the other bolt "grasps at nothing" and the respective door is thus not closed correctly.

U.S. Pat. No. 8,146,864 and DE 3707324 describe a sliding door locking system for a helicopter door having a translationally movable locking system.

US 975,037 describes a door lock designed for use in connection with sliding doors as used on cars, which is simple in construction and operation and does not malfunction.

U.S. Pat. No. 5,297,840 discloses a latch plate for swing doors of a truck, which is movable between a latch engaging position and a retracted position, to thereby avoid interference with vertically movable parts of a tailgate lift.

Current locks for swing and sliding doors are complicated and comprise many moving parts that tend to break, especially when mechanical force is applied thereon, such as when slamming the doors shut. In addition, the structure of current locks is such that a different lock is required for each type or door, and/or requires complicated adjustments and modifications in order for one lock to fit a certain door. Moreover, current locks are designed such that when attempting to open the lock by force and/or when forcefully closing the door, pressure is applied directly on the locking jaw and/or spring, which are thus under a lot of pressure and tend to break/bend, which eventually destroys the locking mechanism.

One specific object of the present invention is to provide a lock for closing swing doors which does not interfere with other constellations of the vehicle such as vertically-movable parts of tailgate lifts in trucks.

Accordingly, the present invention provides a lock that overcomes all of the above disadvantages and more. The object of the invention, as well as other objects will become apparent to those skilled in the art when the following detailed description of the invention is read in conjunction with the accompanying figures and claims.

SUMMARY OF THE INVENTION

The present invention provides a lock 100 for doors comprising: (a) a clip 200 comprising: (i) an anchoring base 201; and (ii) a pinion 202 having a round balled tip, and (b) a lock-body 300 comprising: (i) left and right locking jaws having a proximal end and distal end, the proximal end of both jaws comprise grooves designed to embrace the round balled tip of the pinion 202 from two different directions: vertically and horizontally to the direction of the movement of the door; (ii) a single retaining spring located in between the distal ends of the left and right locking jaws and designed to push the proximal end of the locking jaws against one another; (iii) a retractable bolt 305 designed to fit in between the distal end of the locking jaws and prevent opening of the proximal end thereof; and (iv) a trigger having an open- and closed-position, such that: (i) in the open-position it prevents the retractable bolt from entering in between the distal end of the locking jaws and thereby enabling the jaws to open and embrace the pinion 202 when closing the door; and (ii) in the closed-position, when the pinion 202 is embraced by the jaws, it allows the retractable bolt to enter in between the distal end of the locking jaws to therefore prevent opening of the locking jaws 301, 302; wherein the lock 100 is suitable for both sliding doors and swing doors (simultaneously).

BRIEF DESCRIPTION OF THE DRAWINGS

The invention will be better understood upon reading the following non-limiting description of certain embodiments of the invention, reference being made to the accompanying figures, in which.

DETAILED DESCRIPTION

Figure 1:
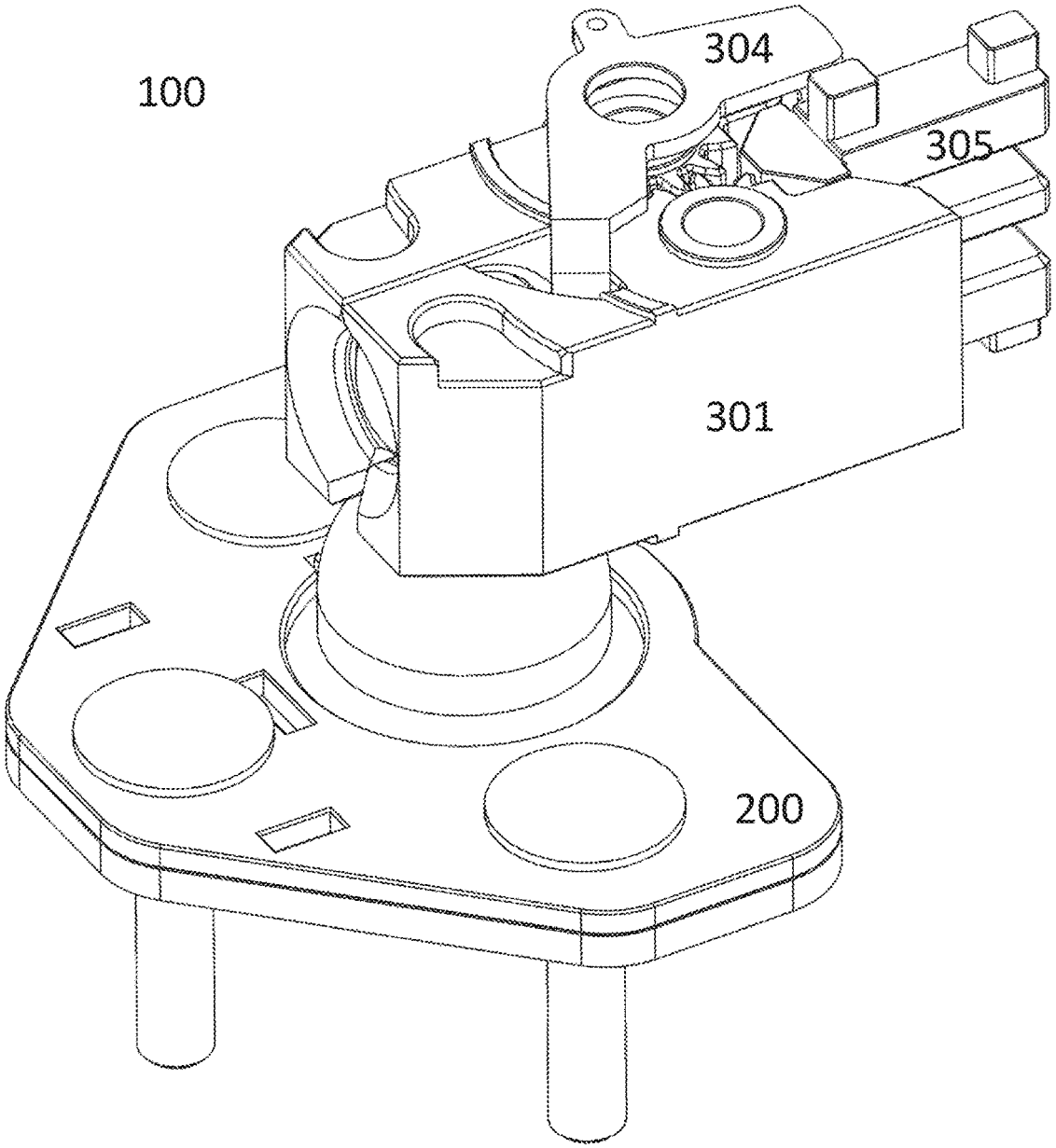
FIG. 1 illustrates one embodiment of a lock assembly according to the invention.

In today's markets, which require massive trucks and delivery vans to deliver goods send from all over the world, a need exists for safe and secured transportation means for safe keeping the delivered goods on the go. Currently, locking the doors of trucks and vans is achieved by standard U-shaped locks, standard automobile locks, or other special designed locks for specific door types. All of these locks have their own drawbacks. For instance, U-shaped locks are cumbersome and large; standard locks do not provide sufficient protection; and special locks are often delicate and/or require special assembly and adjustment to each vehicle and door type.

Accordingly, the present invention provides a lock that can be easily assembled on all door types, especially car doors, with little to no adjustments thereof during installation, which are long-lasting and resilient to forces applied thereon, e.g. when closed shut or forced open.

Another object of the present invention is to provide a lock having a structure which is constructively simple and thus economical and highly reliable in operation.

Accordingly, the present invention provides a lock 100 for doors comprising: (a) a clip 200 comprising: (i) an anchoring base 201; and (ii) a pinion 202 having a round balled tip, and (b) a lock-body 300 comprising: (i) left and right locking jaws designed to embrace the round balled tip of the pinion 202; (ii) a retaining spring designed to push the locking jaws against one another; (iii) a trigger having an open- and closed-position, such that in the closed-position, it prevents opening of the locking jaws 301, 302 once they embrace the pinion 202; and (iv) a bolt designed to prevent movement of the trigger from its closed-position to its open-position, wherein the lock 100 is suitable for both sliding doors and swing doors (simultaneously).

The present invention further provides a lock 100 for doors comprising: (a) a clip 200 comprising: (i) an anchoring base 201; and (ii) a pinion 202 having a round balled tip, and (b) a lock-body 300 comprising: (i) left and right locking jaws having a proximal end and distal end, the proximal end of both jaws comprise grooves designed to embrace the round balled tip of the pinion 202 from two different directions: vertically and horizontally to the direction of the movement of the door; (ii) a single retaining spring located in between the distal ends of the left and right locking jaws and designed to push the proximal end of the locking jaws against one another; (iii) a retractable bolt 305 designed to fit in between the distal end of the locking jaws and prevent opening of the proximal end thereof; and (iv) a trigger having an open- and closed-position, such that: (i) in the open-position it prevents the retractable bolt from entering in between the distal end of the locking jaws and thereby enabling the jaws to open and embrace the pinion 202 when closing the door; and (ii) in the closed-position, when the pinion 202 is embraced by the jaws, it allows the retractable bolt to enter in between the distal end of the locking jaws to therefore prevent opening of the locking jaws 301, 302; wherein the lock 100 is suitable for both sliding doors and swing doors (simultaneously).

In certain embodiments of the lock 100 of the invention, the left and right locking jaws completely engulf/embrace said round balled tip of the pinion 202. This feature, in addition to the unique jaws' locking mechanism, prevents force opening of the lock by applying forces in various directions such as pulling according to the direction of the opening of the door or any other direction (e.g. when using a crowbar).

In certain embodiments of the lock 100 of the invention, the anchoring base is designed to be secured in place to the door itself or to a wall/window-frame/automobile-frame and hold the pinion 202 while preventing its movement, i.e. firmly holds/secures it in place. The anchoring of the base can be done in any suitable manner, such as by screws and bolts, nits, pins, welding, etc.

Figure 2:
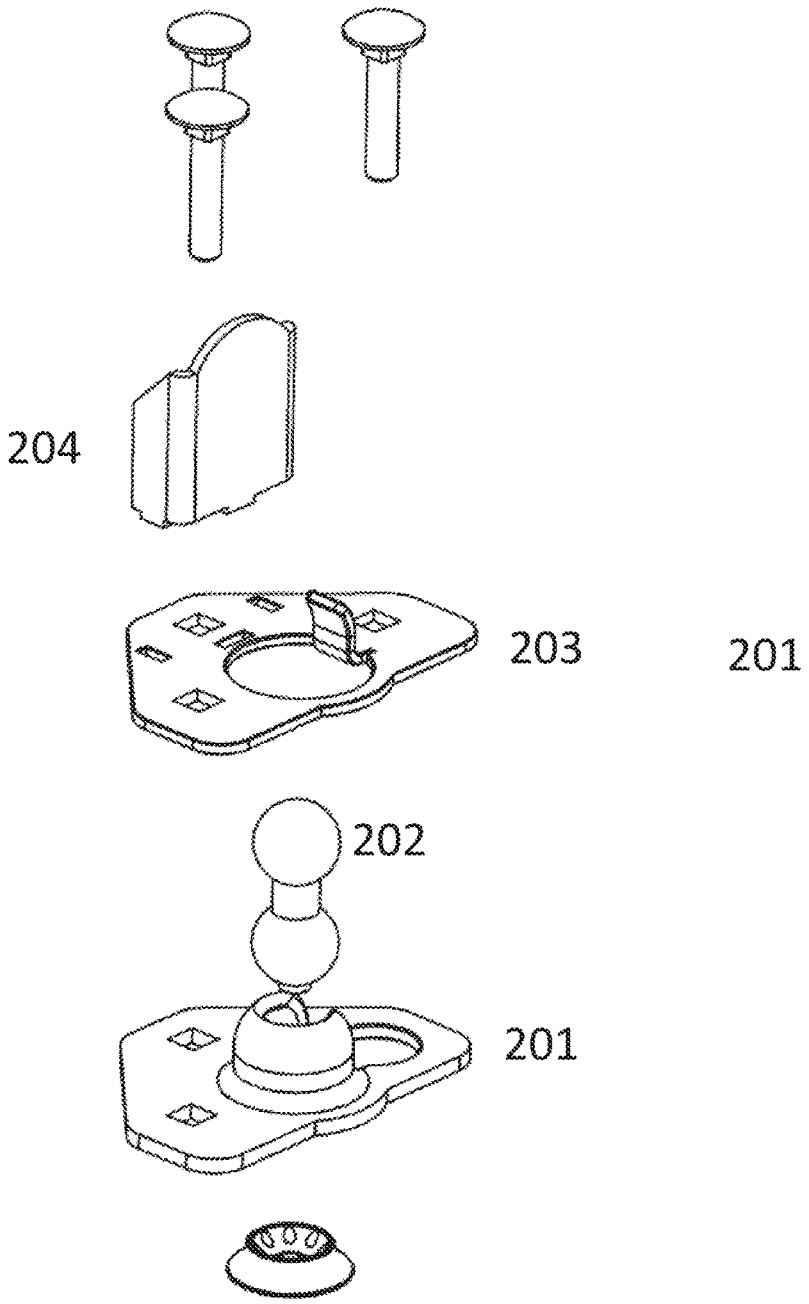
FIG. 2 illustrates one embodiments of the components of an anchoring base according to the invention.

As seen in FIG. 2, the anchoring base may comprise one, two or more layers, and may be secured to the wall/frame with screws and bolts (as illustrated), but may also be secured using pins, welding or any other suitable way. The anchoring base is designed to hold the pinion 202 and may comprise a dedicated groove for holding same, wherein the position of the pinion 202 may be modified during installation and finally fixed once reaching the final desired position/location thereof. In certain embodiments, the tip of the pinion 202 that is inserted into the groove in the anchoring base is rounded/ball shaped. Alternatively, it is in any other shape, such as rectangle, square, or other quadrangle shape. The purpose of this tip is to assist in affixing the pinion 202 in place. In specific embodiments, the pinion 202 is secured/affixed in place with the aid of a fastening screw or bolt. Alternatively, as seen in FIG. 2, a strike bracket is first secured in place, and then the pinion 202 is inserted into a dedicated groove and fastened with a strike counter plate 203. FIG. 2 further shows a front protector 204 designed to either protect the pinion 202 from unintentional hits and/or prevent unintentional injury from the pinion 202, and/or prevent access to the locking jaws when the lock is in closed position, e.g. in a sliding door.

Figure 3A:
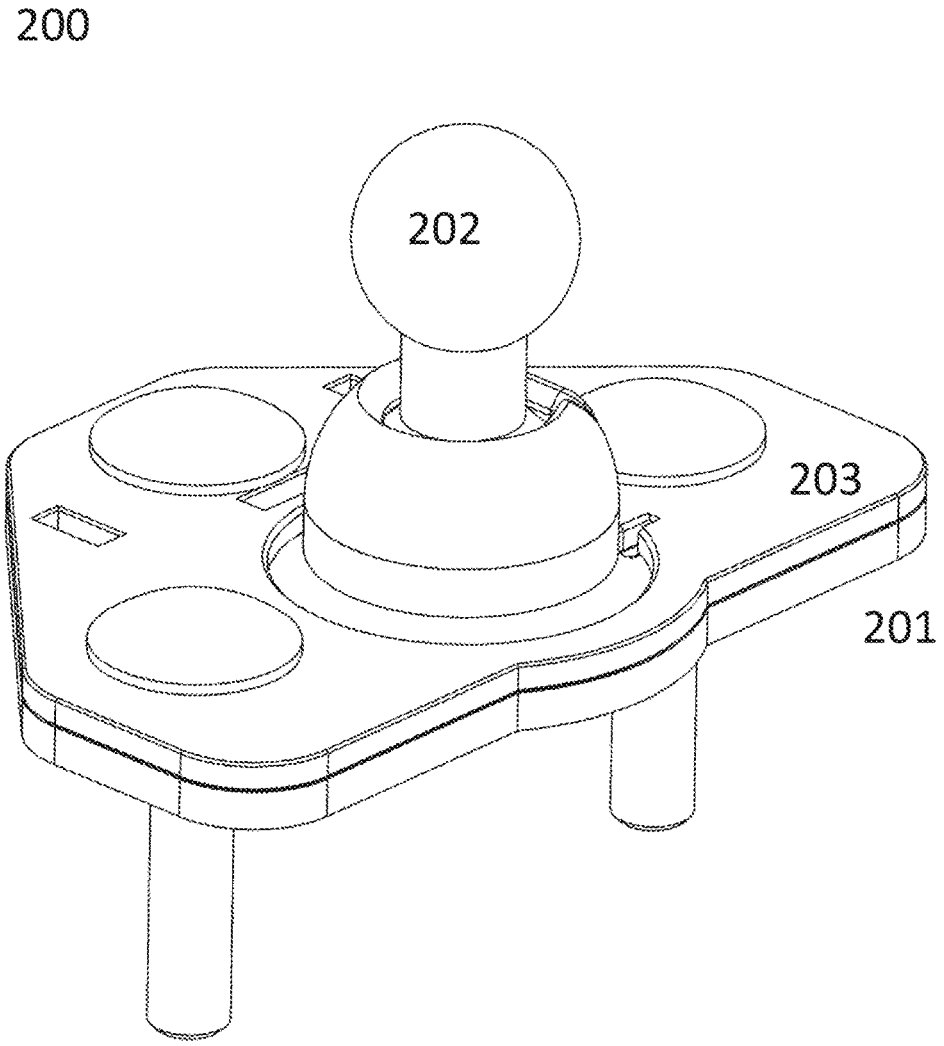
FIGS. 3A-3B illustrate two possible configurations of an anchoring base according to the invention.
Figure 3B:
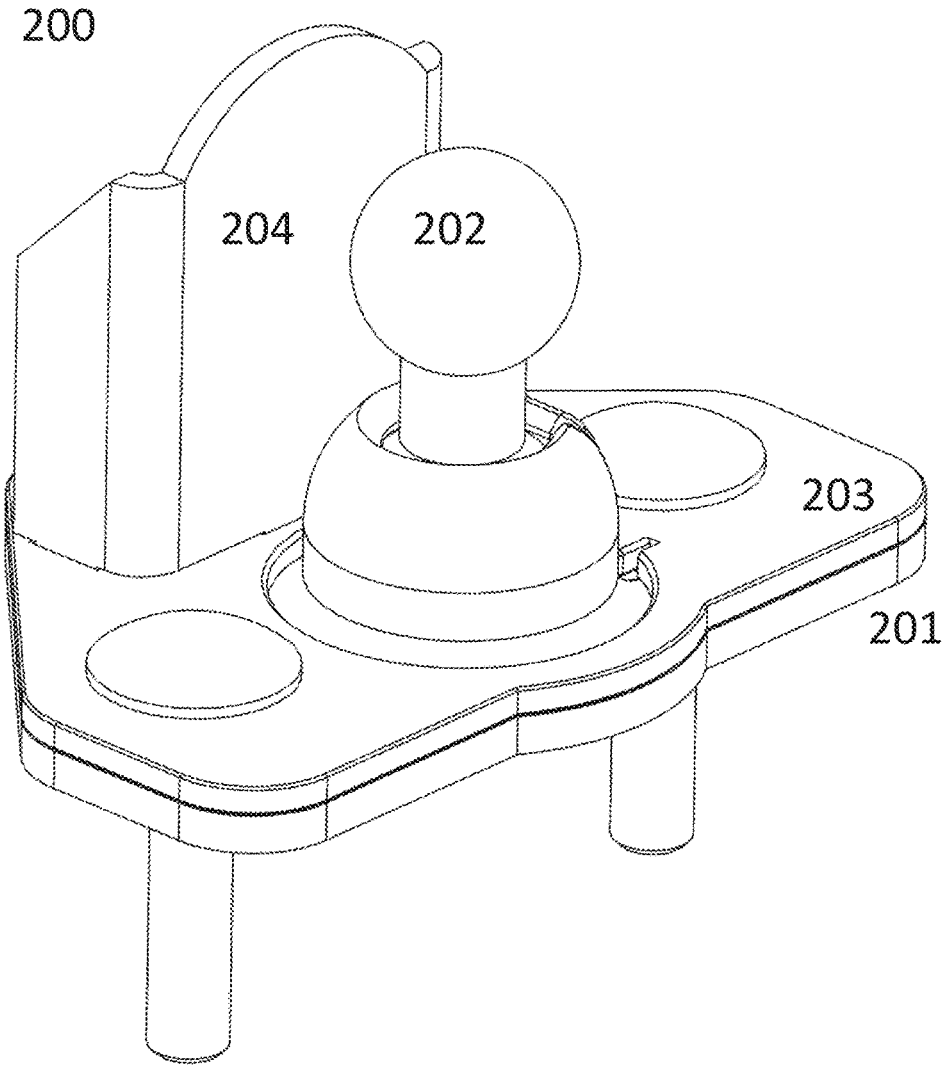

As shown in FIGS. 3A and 3B, the final assembled clip 200 may have various final configurations, according to the door being locked. FIG. 3A illustrates a common lock configuration for swing doors allowing more flexibility for the lock, and FIG. 3B illustrates a lock that is commonly used with slide doors in horizontal install where the front protector 204 is blocking access to the lock. In other cases, e.g., in narrow spaced installations, a pinion 202 with a flat strike bracket can be used and the front cover 204 and strike counter plate 203 can be omitted.

Figure 4A:
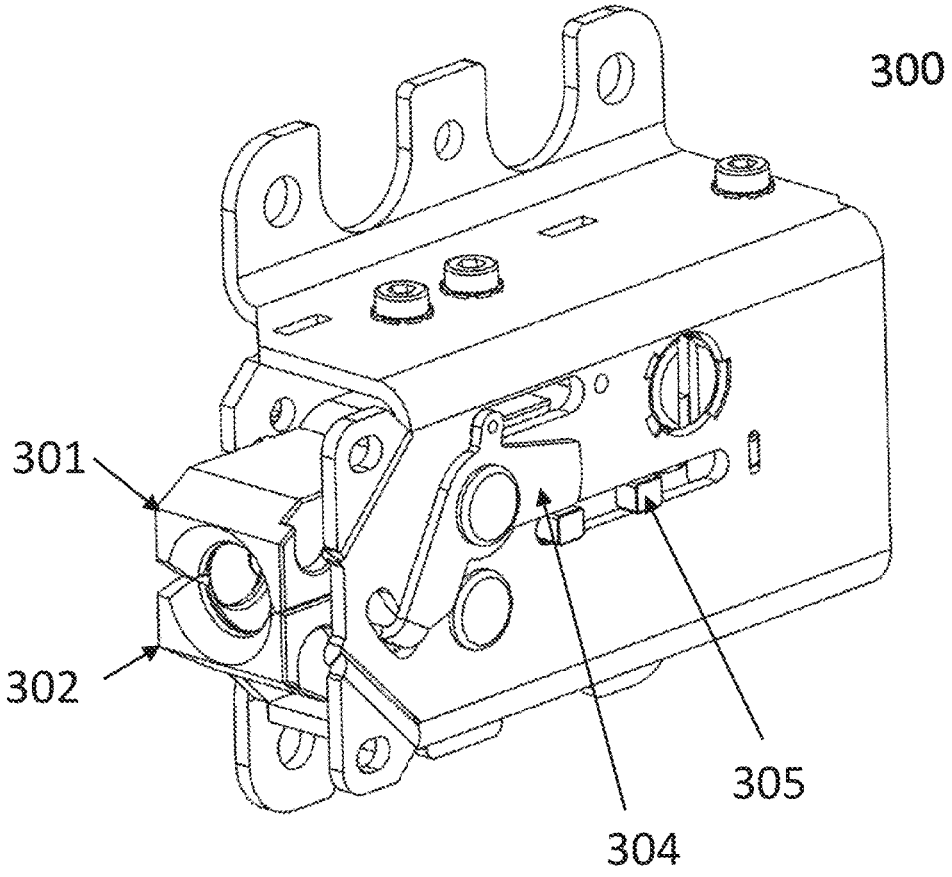
FIGS. 4A-4C illustrate a lock body according to embodiments of the invention.
Figure 4B:
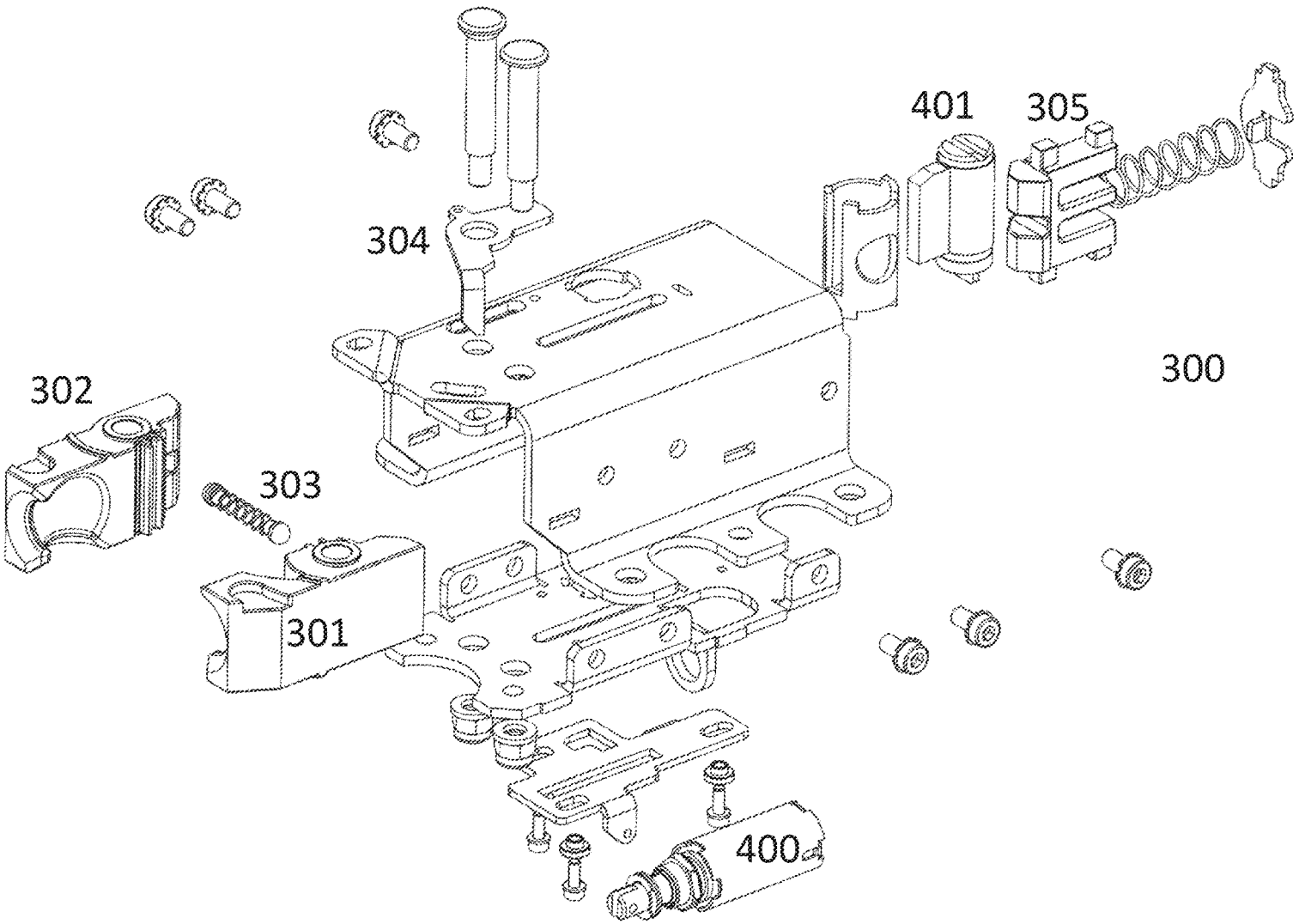
Figure 4C:
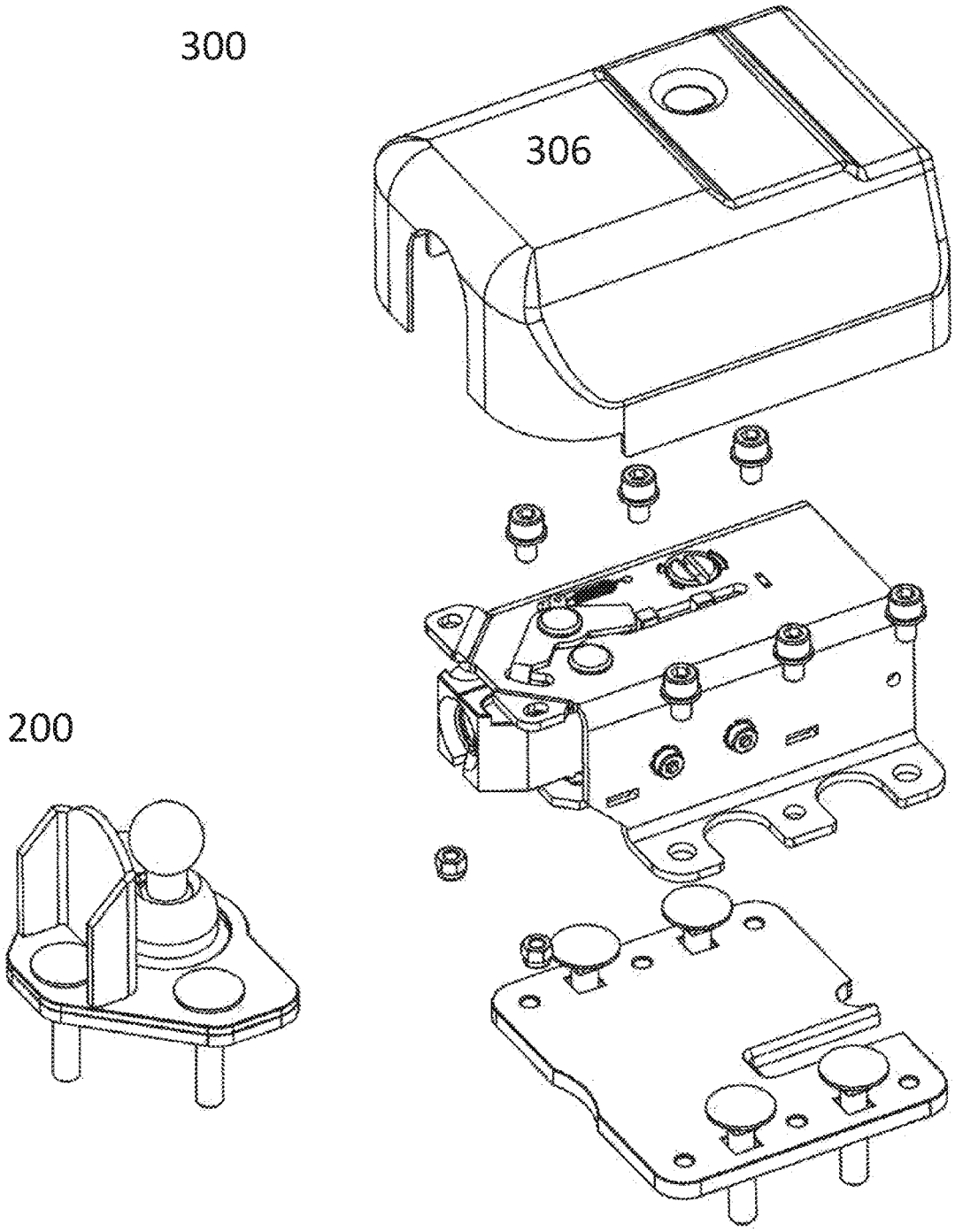
Figure 5:
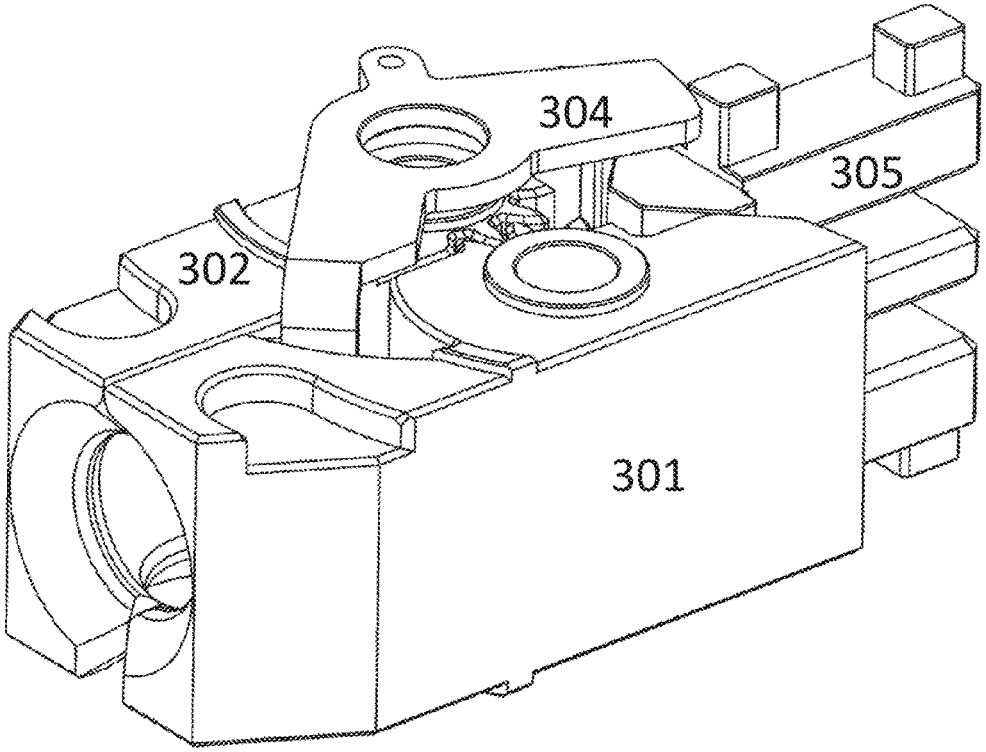
FIG. 5 illustrates one configuration of the locking jaws unit of the invention.
Figure 6A:
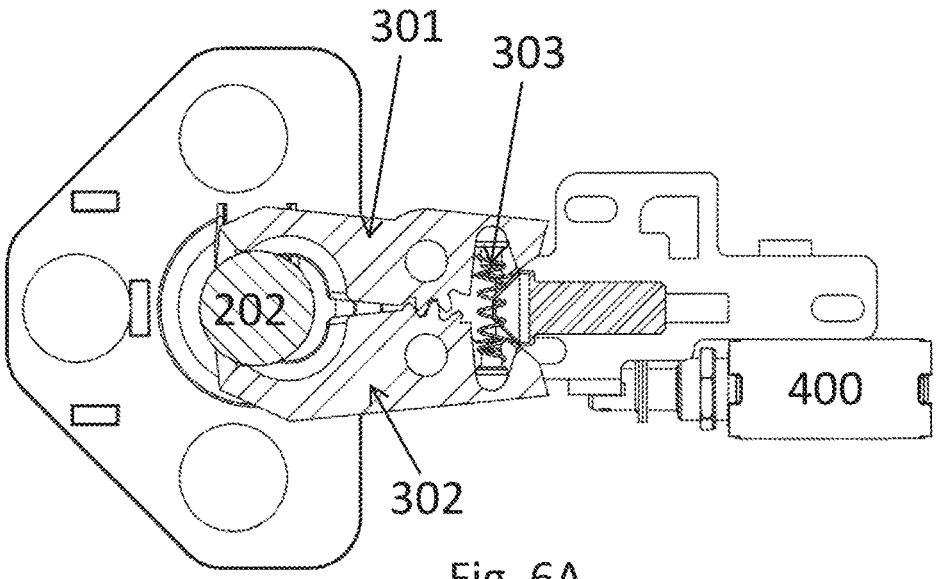
FIGS. 6A-6F illustrate an assembled lock of the invention from different directions.
Figure 6B:
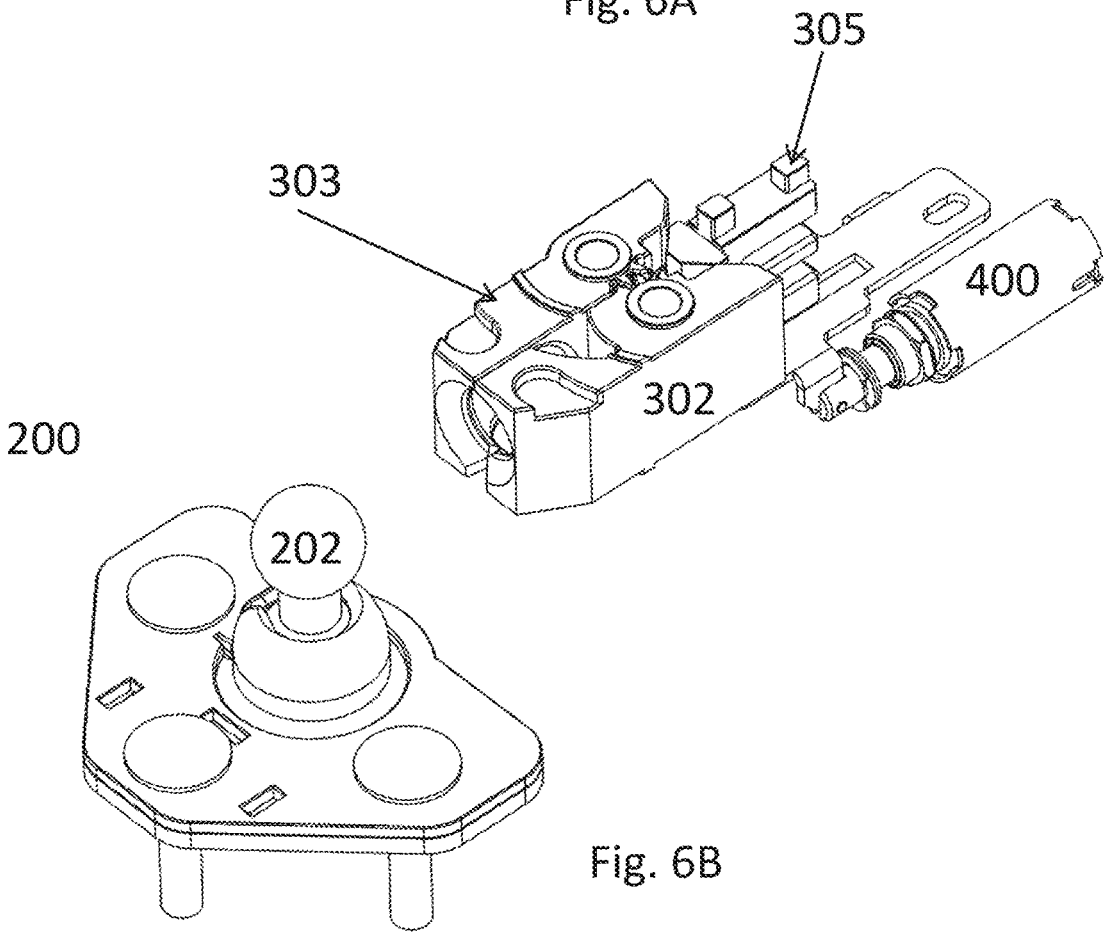
Figure 6C:
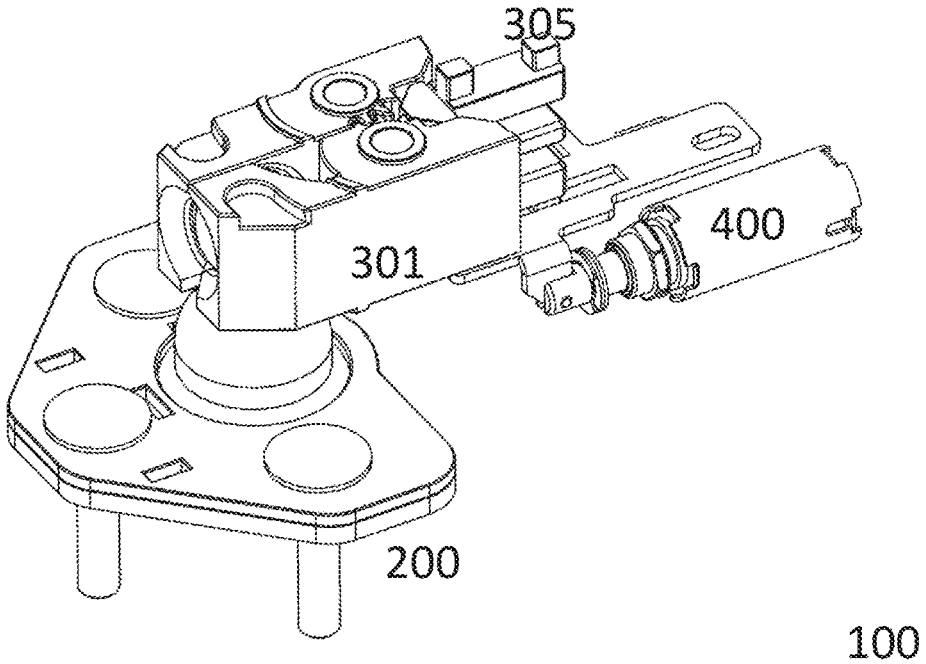
Figure 6D:
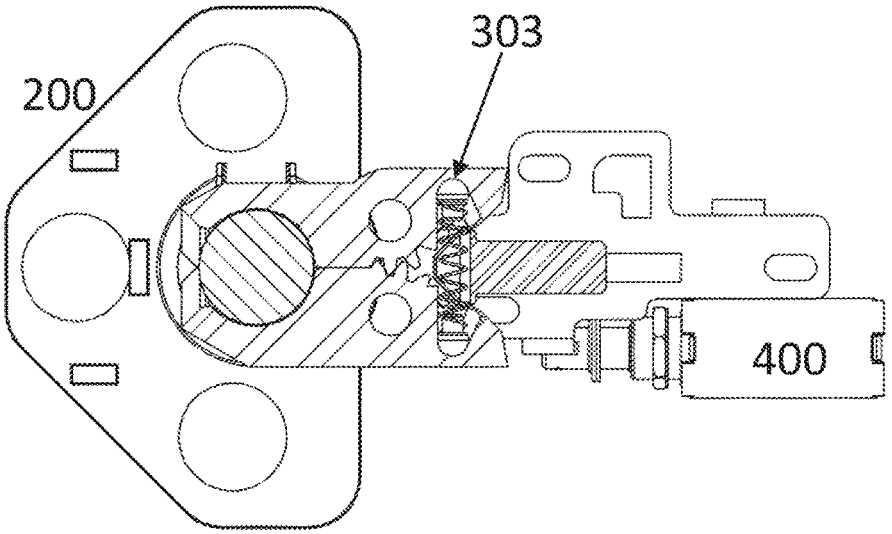
Figure 6E:
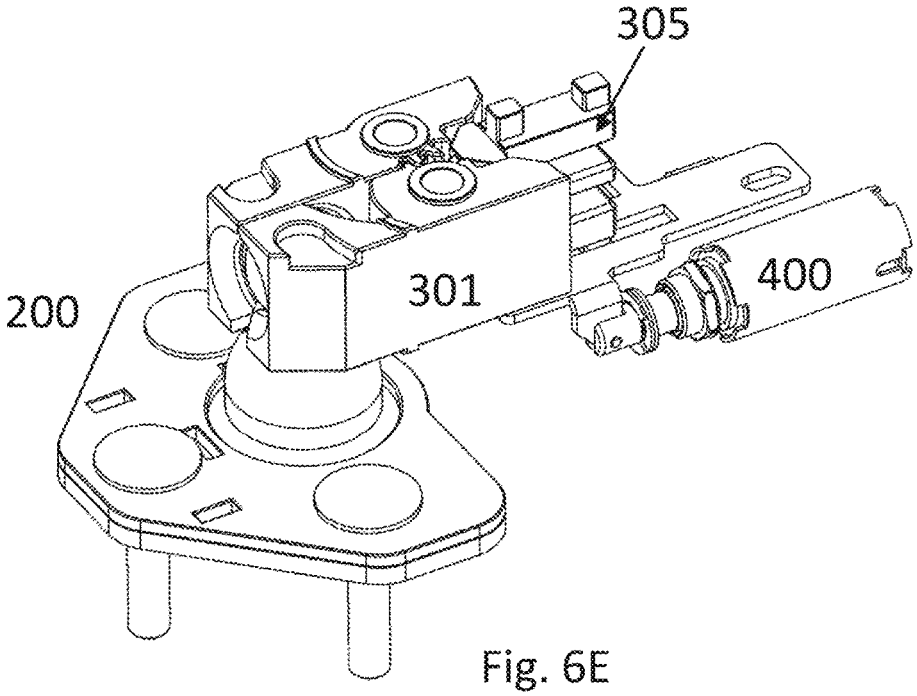
Figure 6F:
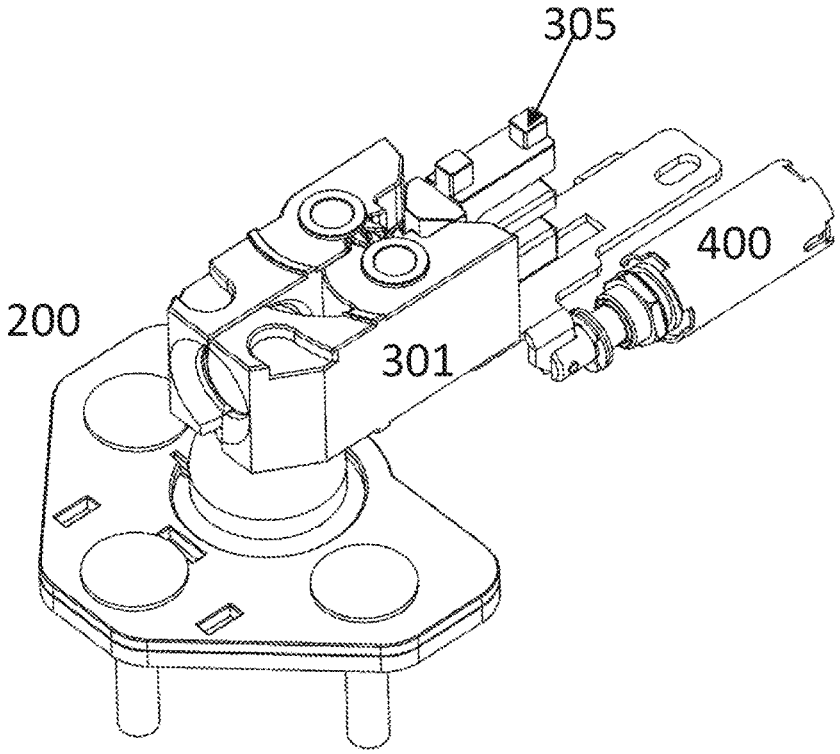

As seen in FIGS. 4A-4C, the main components of a lock body 300 according to the invention are a left and right locking jaws 301, 302; a single retaining spring for pushing the locking jaws against one another; a bolt for preventing opening of the locking jaws after embracing a pinion 202; and a trigger for preventing movement of the bolt from closed- to open-position. FIG. 5 shows the locking jaws the bolt and the trigger in assembled configuration. FIGS. 6A-6F illustrate the main components of an assembled lock 100 according to the invention from several points of view.

Figure 7A:
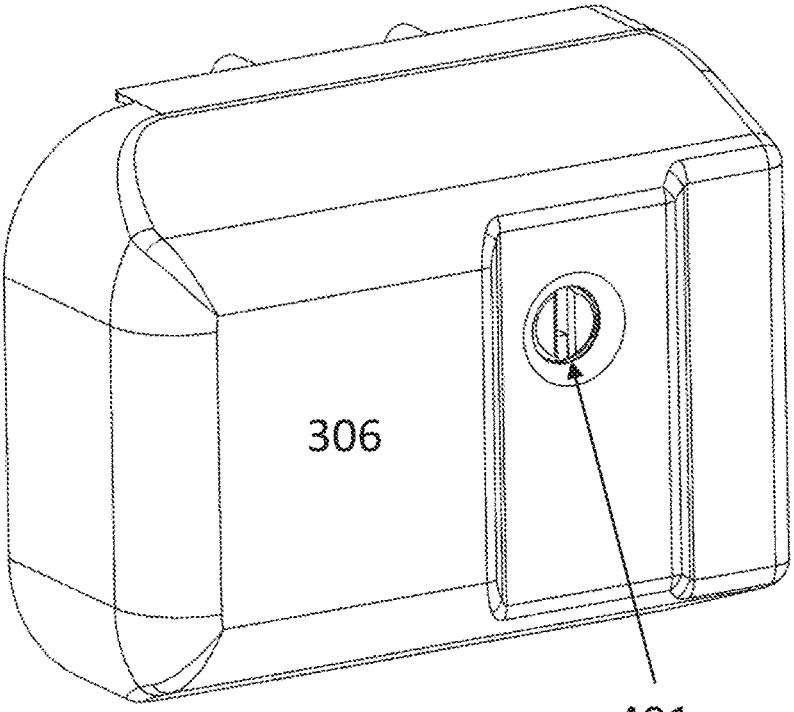
FIGS. 7A-7M illustrate components of a lock of the invention with a protective case thereon.

In certain embodiments, the lock body 300 is covered, after secured in place, with a sealed cover 306 to prevent access thereto and to protect it from harm. In alternative or additional embodiments, the clip 200 is covered, after secured in place, with a sealed cover 306 to prevent access thereto and to protect it from harm. See, e.g., FIG. 7C showing a clip with a protective cover 306 thereon.

Figure 7B:
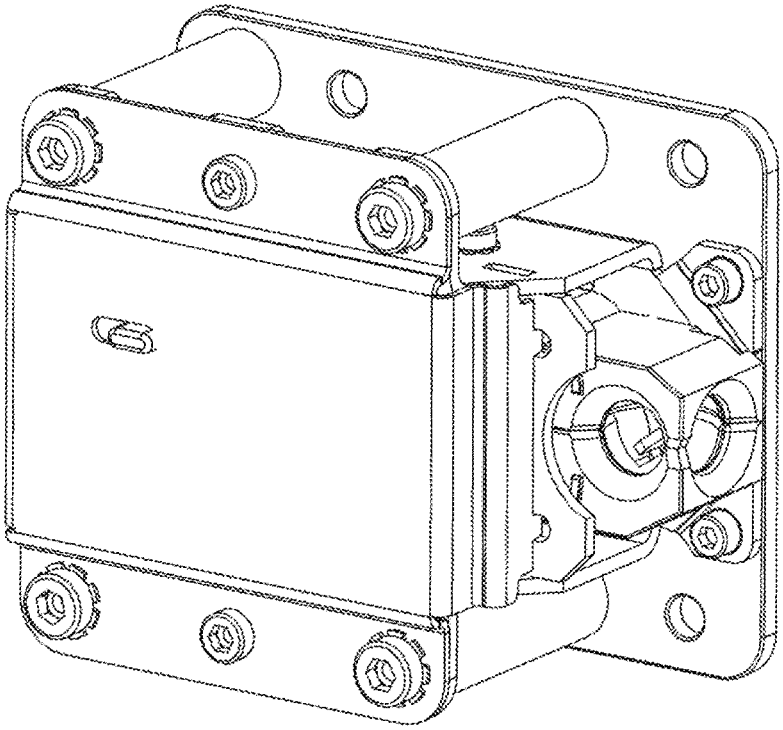
Figure 7C:
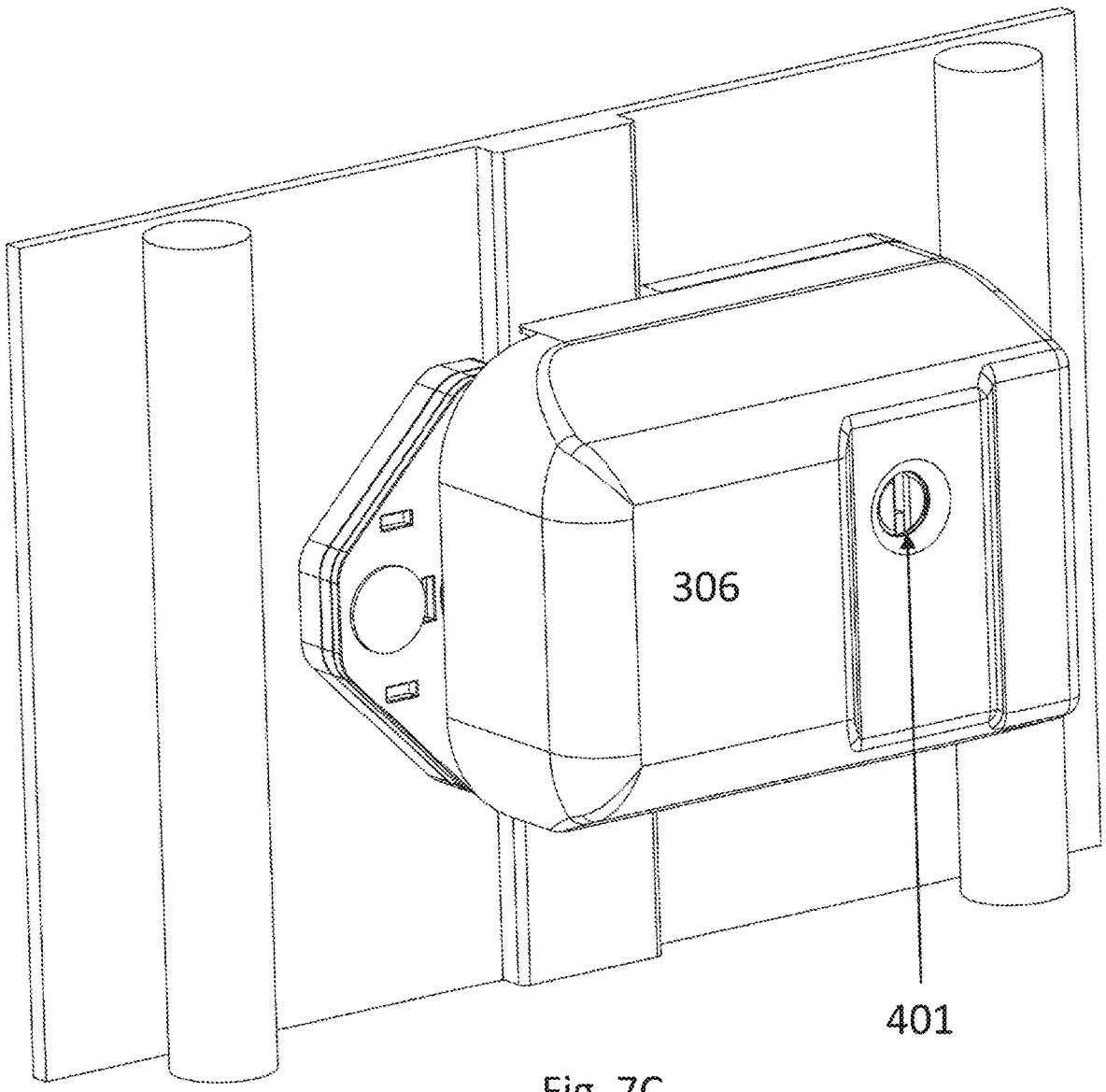
Figure 7D:
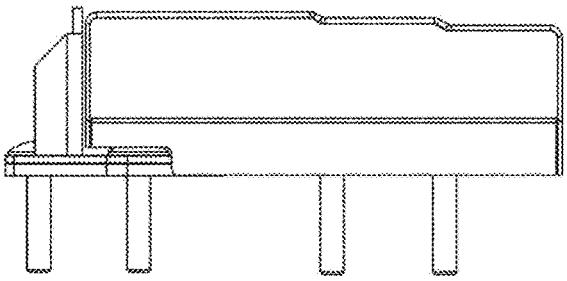
Figure 7E:
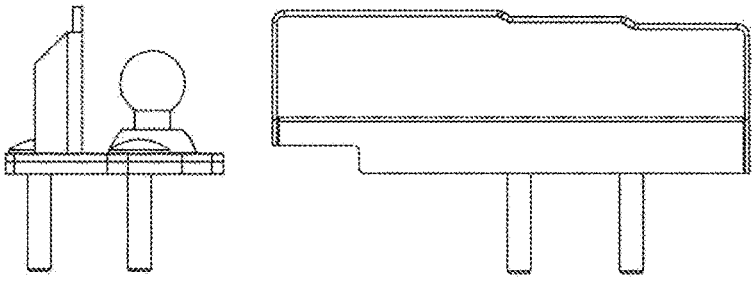
Figure 7F:
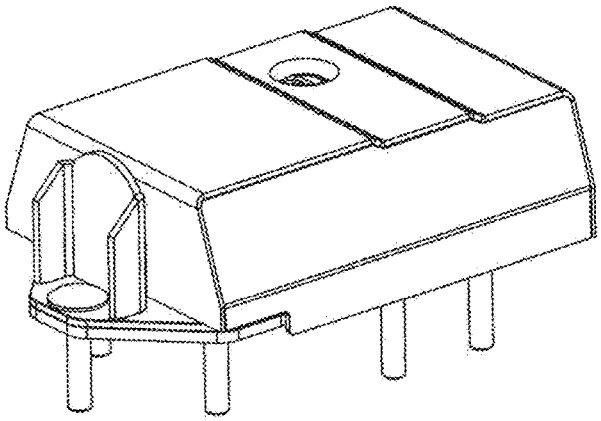
Figure 7G:
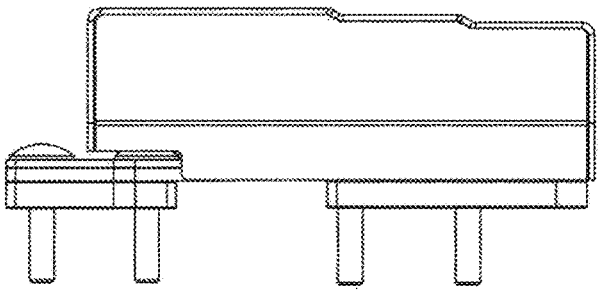
Figure 7H:
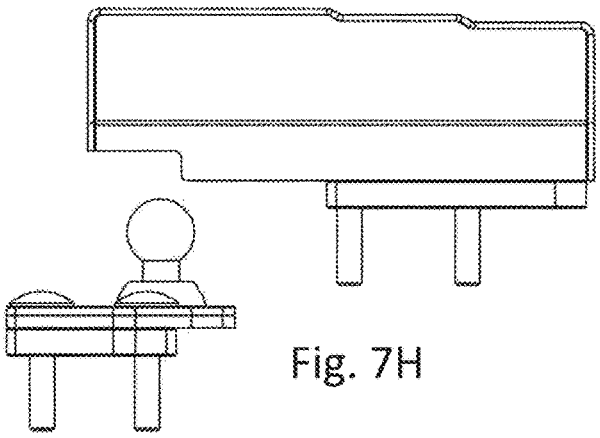
Figure 7I:
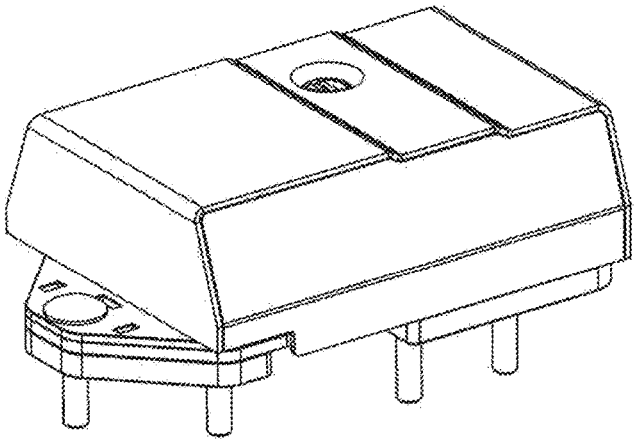
Figure 7J:
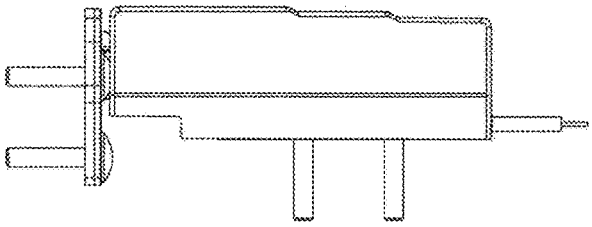
Figure 7K:
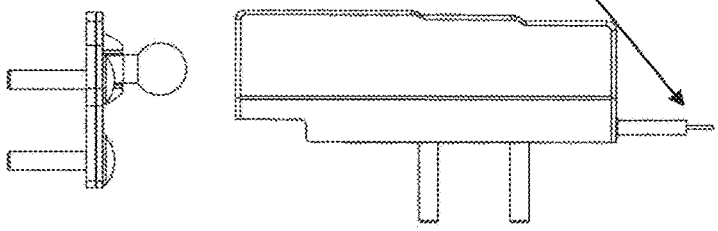

FIG. 7B shows a lock body according to an embodiment of the invention with a protective cover 306 thereon, wherein the lock 100 is assembled in a reverse manner, i.e. internally (so that it is protected from external potential vandalism). FIGS. 7D-7F describe a lock according to an embodiment of the invention for an external assembly (which might be exposed to vandalism) for a sliding door, e.g., when assembled onto a truck's rear door. FIGS. 7G-7I describe a lock for an external assembly for a swing/revolving door.

Figure 7L:
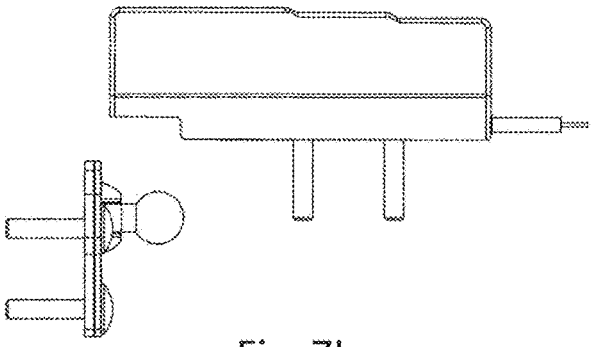
Figure 7M:
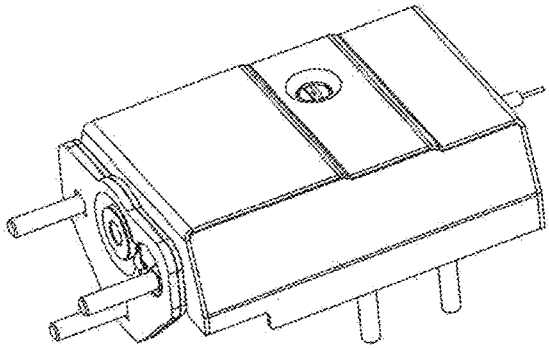

FIGS. 7J-7M describe a lock 100 according to an embodiment of the invention for an internal assembly that fits both a sliding door (FIG. 7K) and a revolving door (FIG. 7L). In these figures, the lock is further equipped with an emergency opening cable 500 that can be connected to a special location in the driver's compartment, such as a locking cylinder, and may by pulled manually when needed. The pulling of the emergency opening cable 500 brings the lock into its open state and allows opening thereof.

In certain embodiments of the lock 100 of the invention, the lock-body 300 further comprises: (i) a locking cylinder 401 associated with a respective actuation key (illustrated, e.g., in FIGS. 4B, 7A and 7C); and/or (ii) a solenoid 400 (illustrated, e.g., in FIGS. 4B, 6, 8 and 9), and the bolt is associated with either one or both.

In certain embodiments of the lock 100 of the invention, turning of an actuation key inside the locking cylinder 401; and/or activating the solenoid results in the movement of the bolt and subsequently the opening or closing of the lock 100.

In certain embodiments of the lock 100 of the invention, the left and right locking jaws comprise grooves designed to embrace the round balled tip of the pinion 202 from two possible different directions: vertically and horizontally to the direction of the movement of the door. This configuration enables the embracing of the pinion 202 from two directions, respective to swing- and slide-doors. Accordingly, the "front" grooves are for use, e.g., with slide doors in which the locking jaws and pinion approach one another in a horizontal direction; and the "side" grooves are for use with, e.g., swing doors in which the locking jaws and pinion approach one another in a vertical direction. Notably, side doors can move vertically or horizontally, and some swing doors in trucks include roller doors that can be locked horizontally or vertically.

Figure 8A:
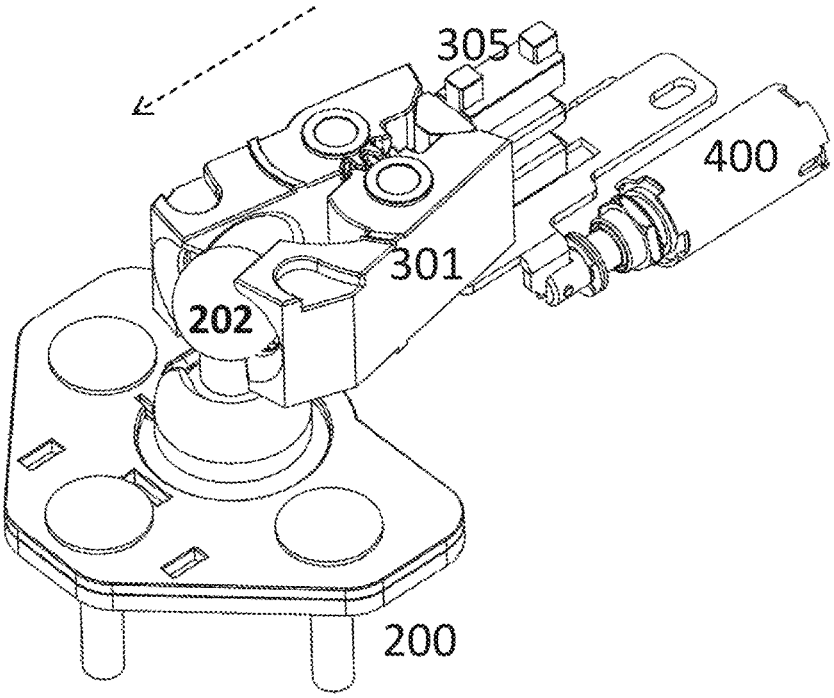
FIGS. 8A-8B illustrate how a lock of the invention operates in a sliding-door constellation.
Figure 8B:
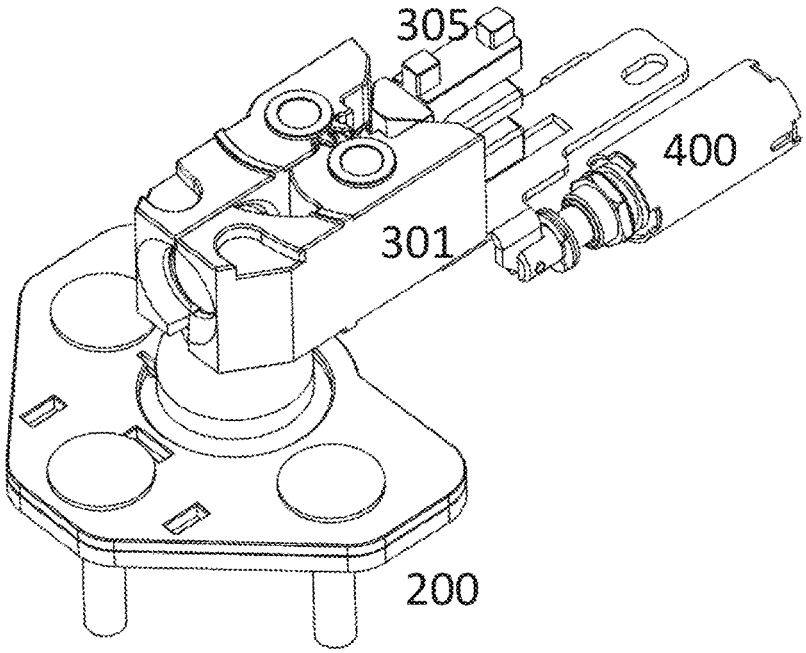
Figure 9A:
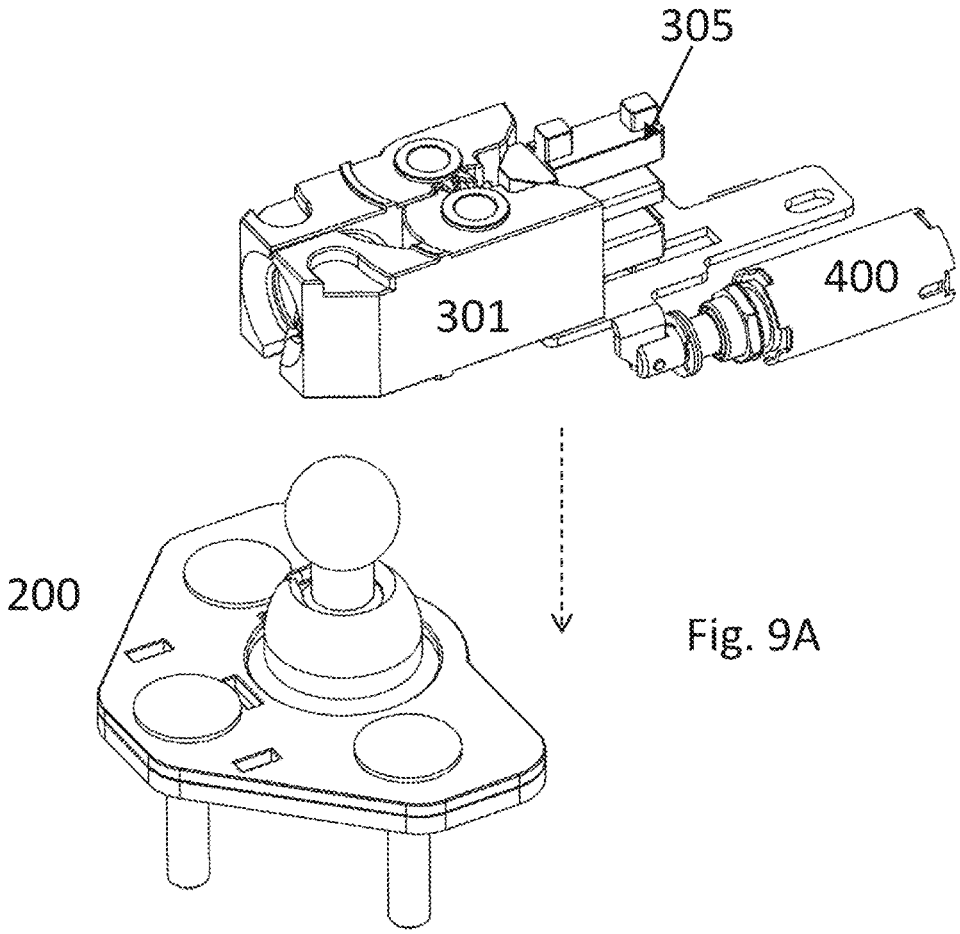
FIGS. 9A-9B illustrate how a lock of the invention operates in a swing-door constellation.
Figure 9B:
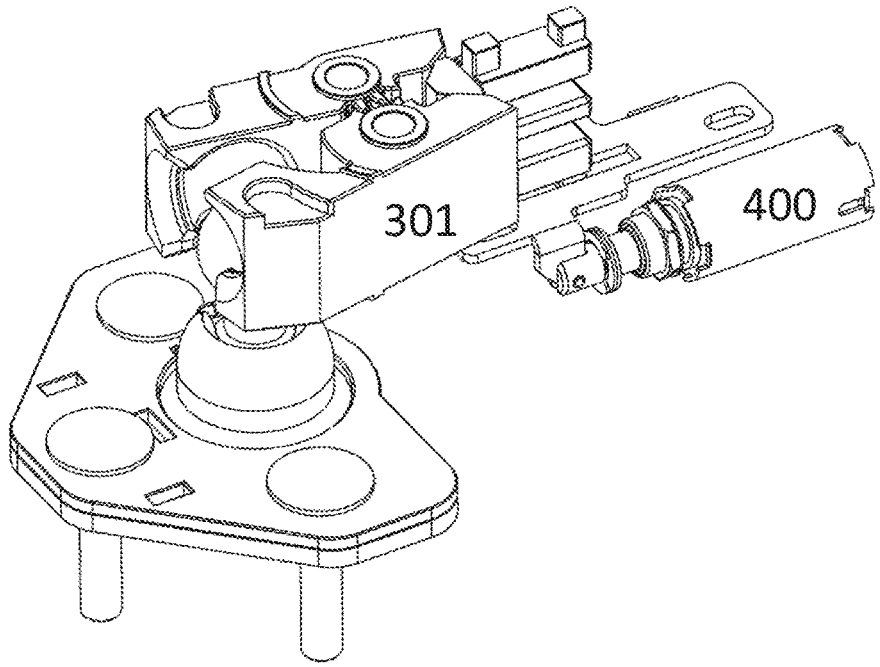

FIGS. 8A and 8B illustrate how the locking jaws 310, 302 embrace a pinion 202 via the "front" grooves in a sliding movement. FIGS. 9A and 9B illustrate how the locking jaws 310, 302 embrace a pinion 202 via the "side" grooves in a swing/arch movement: FIG. 9A shows a down-movement of the lock body 300 towards a pinion 202, whereas FIG. 9B shows how the left and right locking jaws are separated from one another when the pinion 202 is pressed against them. When looking at these figures in reverse, they illustrate how the bolt is pulled back to release the locking jaws which thus enables the release of the pinion 202 and the lifting of the lock body 300 away from the pinion 202 (or lifting the pinion from the lock body, or separating them from one another simultaneously).

Figure 10A:
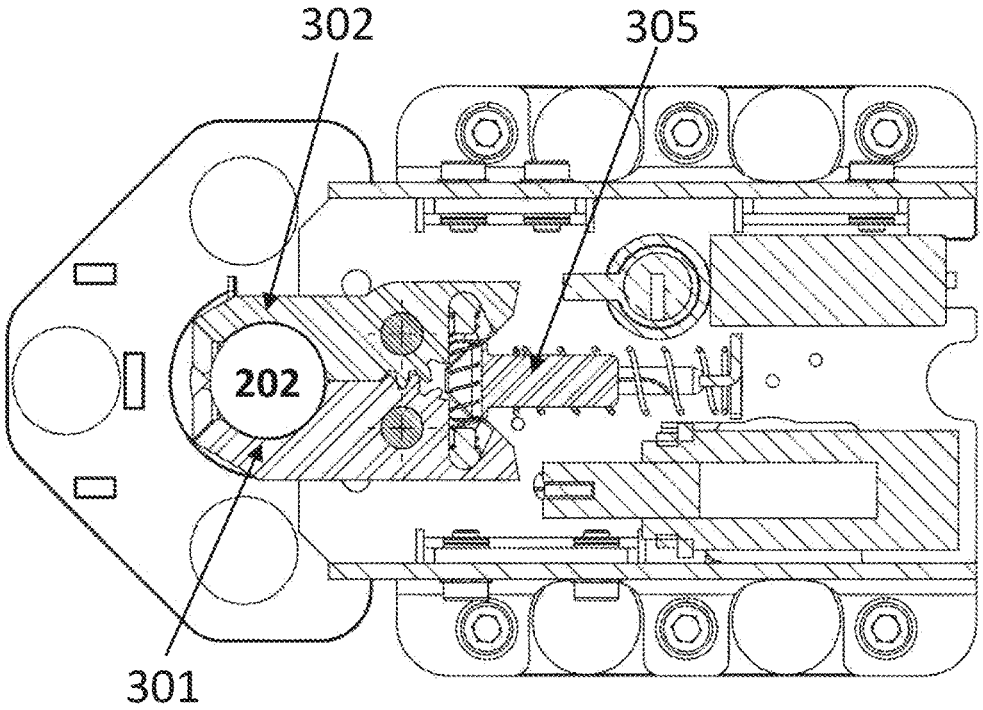
FIGS. 10A-10C illustrate the position of the bolt when the lock is in closed-(FIG. 10A) or open-position (FIGS. 10B & 10C).
Figure 10B:
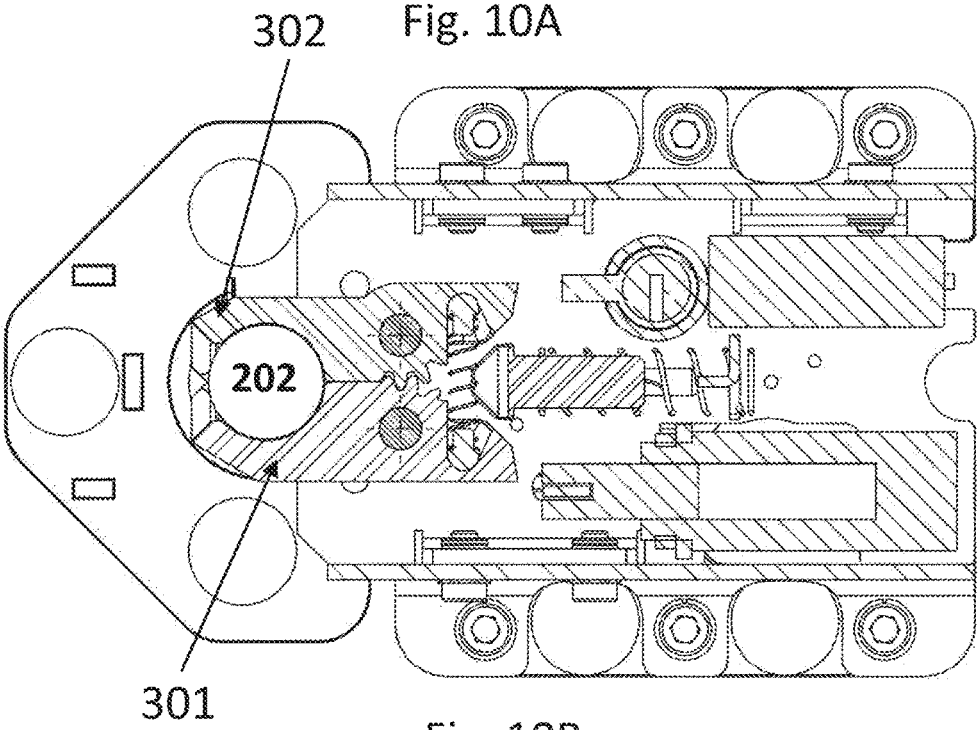
Figure 10C:
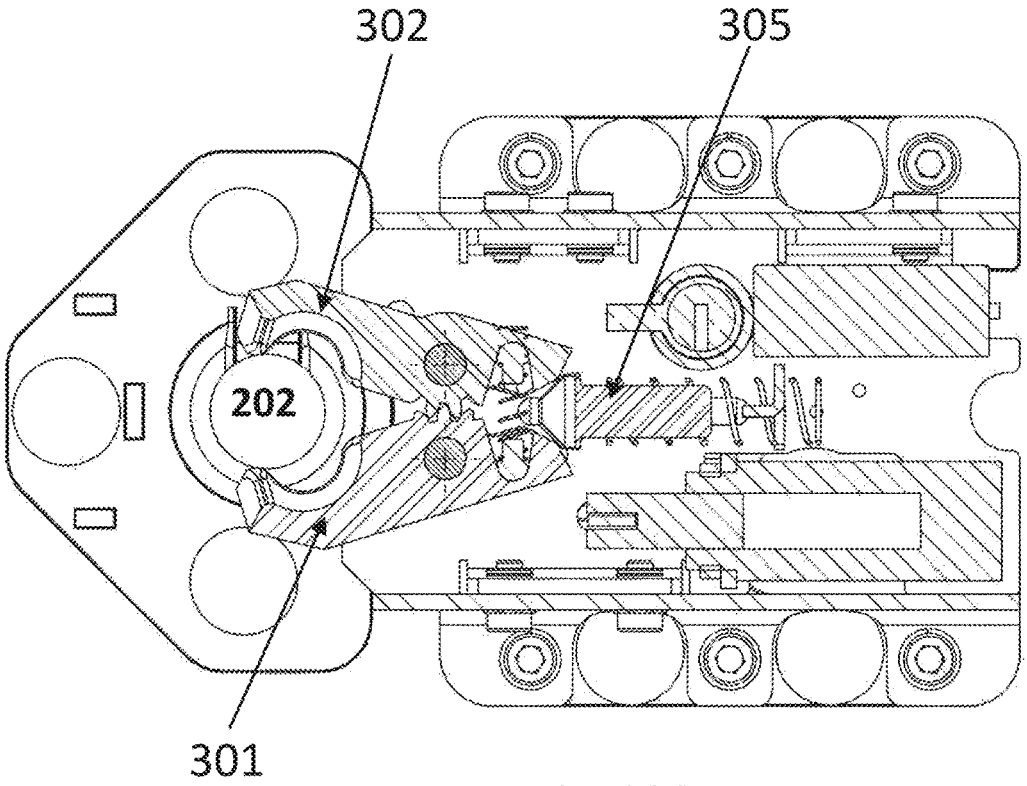

FIGS. 10A-10C illustrate the internal movement of the bolt between closed- and open-positions of the lock 100 according to any of the embodiments above: As seen in FIG. 10A, the head of the bolt is positioned in between the distal end of both locking jaws thereby preventing their movement and the opening of the proximal end thereof and the release of the pinion 202. However, when the bolt is pulled back, by the locking cylinder 401 and/or the solenoid 400 (FIG. 10B), the locking jaws can move to thereby open the proximal end thereof and the release the pinion 202 (FIG. 10C).

In certain embodiments, the lock 100 of the present invention provides a positive locking mechanism, which means that the insertion of the bolt in between the distal ends of the locking jaws actively prevents the opening of the locking jaws 301, 302. This is contrary to "passive" locks which rely on geometric construction or spring-force to maintain the lock locked. Notably, known locks comprise a separate mechanism for maintaining the locking jaws in an open-wide position when opening the door, in order to be able to embrace the pinion once the door is closed shut. In such locks, if the locking jaws are not kept open, when the door is closed, the pinion cannot enter in between the locking jaws, and the door remains open. Contrary to such known locks, the construction of the locking jaws 301, 302 and the bolt according to the invention renders redundant the use of a mechanism for maintaining the locking jaws open. This is since when the bolt is retracted, i.e. not in between the distal end of both locking jaws which means that the locking jaws can be opened easily when pressed against the balled-shaped tip of the pinion 202. The omission of such a mechanism for maintaining the locking jaws in an open-wide position means that the lock is much less susceptible to malfunction, and is cheaper and simpler for manufacture and maintenance.

Figure 11A:
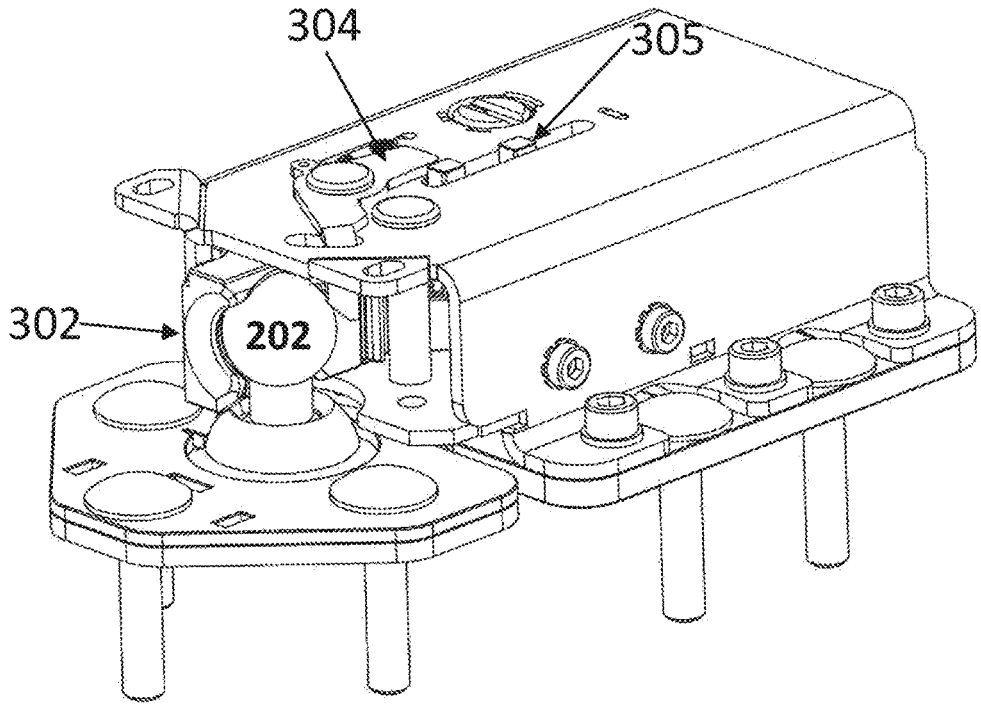
FIGS. 11A-11B illustrate the position and relationship between the trigger and bolt when the lock is in closed-position (FIG. 11A) when the pinion is engulfed by the locking jaws; and when the lock is in open-position (FIG. 11B) when the pinion is not engulfed by the locking jaws.
Figure 11B:
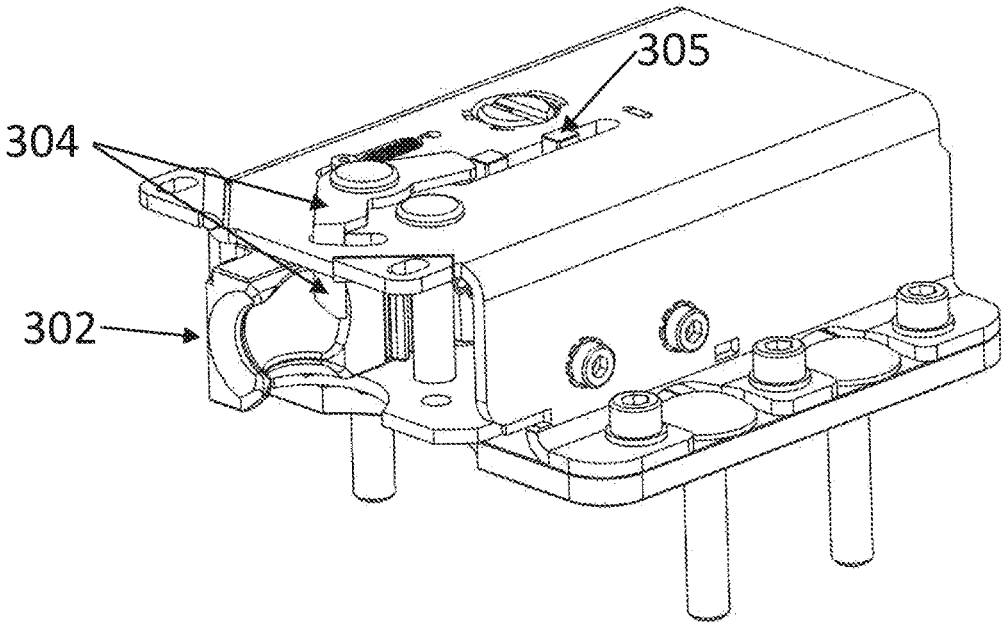

FIGS. 11A-11B illustrate the position and relationship between the trigger and bolt when the lock is in a closed-position (FIG. 11A), i.e., when the pinion 202 is engulfed by the locking jaws 301, 302; and when the lock is in an open-position (FIG. 11B), i.e., when the pinion 202 is not engulfed by the locking jaws or when opening the lock and releasing the pinion 202 from the locking jaws 301, 302. As seen in FIG. 11B, when the pinion 202 is not in between the locking jaws the trigger is positioned such that it holds the bolt backwards to thereby enable free movement of the locking jaws 301, 302. However, when the pinion 202 enters into the groove in the proximal end of the locking jaws is presses on the inner part of the trigger, and thereby releases the bolt and enable its movement forward in between the distal end of the locking jaws to thereby prevent any movement of the locking jaws 301, 302.

Figure 12A:
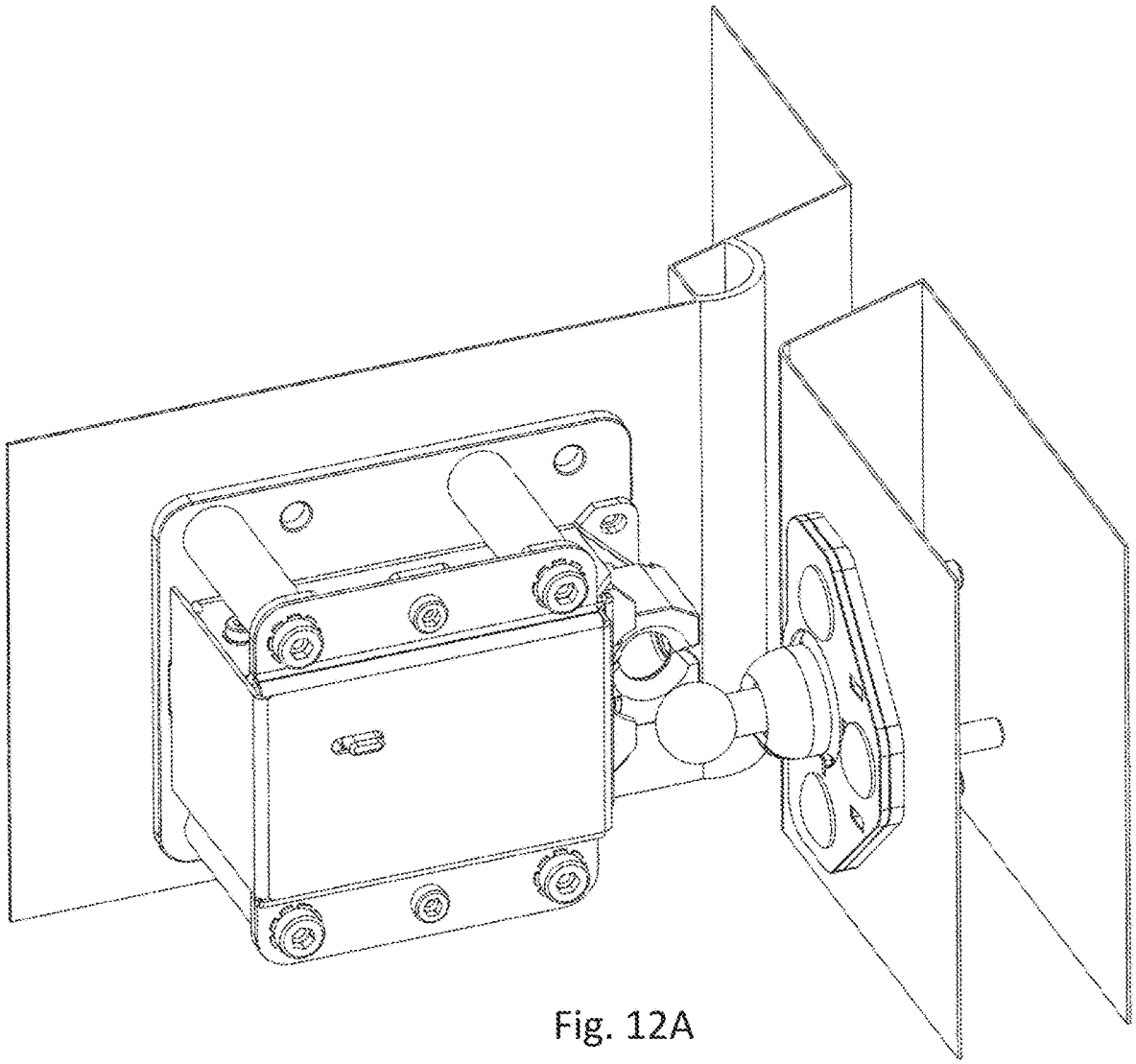
FIGS. 12A-12B illustrate how a single lock of the invention can be mounted on both swing-door and slide-door constellations.
Figure 12B:
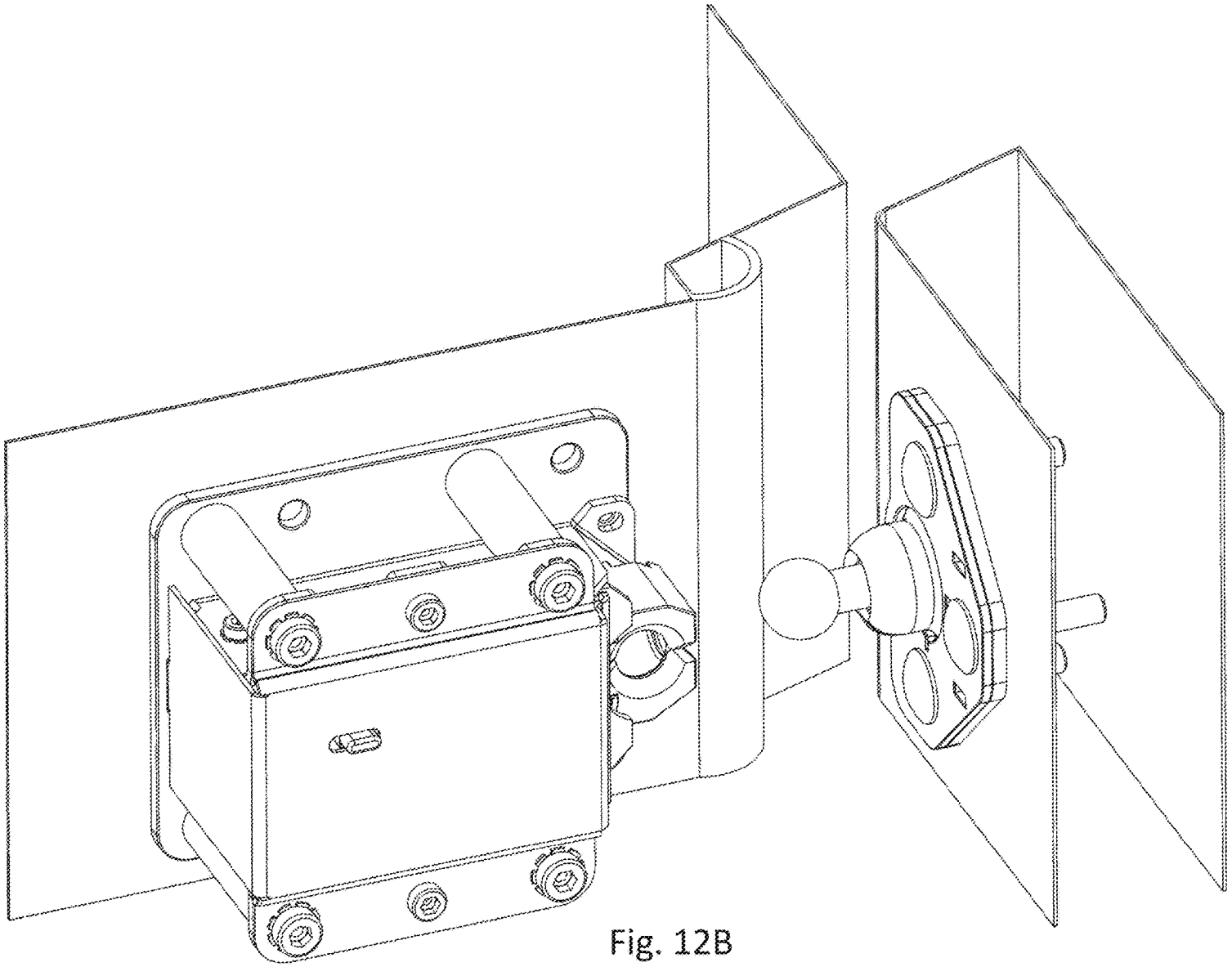

FIG. 12A illustrates how the lock 100 of the invention is mounted on a door and frame of a sliding door constellation, in which the door slides until it reaches the locking point, and FIG. 12B illustrates how the lock 100 of the invention is mounted on a door and frame of a slide door constellation, in which the door slides till a certain point and then twists to complete the locking. Notably, the same lock 100 of the invention fits both constellations without any special adjustments.

The lock 100 of claim 1, having (i) an open-state, in which the trigger is in its open-position pushing, and the bolt is pulled/pressed back and thus allowing at least one of the left and right locking jaws to depart from one another to allow either releasing the pinion 202 engulfed therebetween or to engulf the pinion 202 as the locking jaws 301, 302 and the pinion 202 are pushed one against the other; and (ii) a closed-state, in which after the pinion 202 is engulfed by the locking jaws the trigger is pushed/pressed by the pinion 202 into its close position to thereby release the bolt and allowing it to move forward in between the locking jaws and thus prevents the locking jaws 301, 302 from moving apart and release the pinion 202 engulfed therebetween. In the open position, the distal ends of the locking jaws are free to be pushed against each other (to open the proximal end thereof), whereas in the lock position, the bolt is positioned between the distal ends of the locking jaws and prevent the opening of the proximal end thereof.

In certain embodiments of the lock 100 of the invention, when the pinion 202 is not in between the locking jaws the trigger is in its open-position and the bolt is pulled/pushed back, thus preventing locking the two locking jaws together. This is for preventing locking of the locking jaws together and enabling their opening for engulfing the pinion when pushed one against the other. This enables keeping the jaws in a pseudo-open state without using dedicated mechanism for opening the jaws when the door is open, as seen in many of the prior art locks.

In alternative embodiments of the lock 100 of the invention, when the pinion 202 is in between the locking jaws the trigger is pressed to its closed-position and the bolt moves inwardly into between the distal end of the two locking jaws thus locking the two locking jaws together and preventing their opening/separating. This is for locking the locking jaws together and preventing unlocking and release of the engulfed pinion 202 therefrom when pulled apart.

In certain embodiments, the lock 100 of the invention is designed such then when in a locked position, in which a pinion 202 is engulfed by the locking jaws any pulling forces applied thereon (e.g. when force opening the lock 100 and/or when forcefully slamming the door shut) do not directly affect the bolt and trigger. Notably, in known locks, the locking is based in geometric structure and/or spring forces, both of which are susceptible to forces applied in any direction other than the standard door closing direction.

Notably, due to the ball-shaped tip of the pinion 202, the structure of the grooves within the locking jaws and the use of the bolt 305, it is impossible to force open the lock 100 even when trying to break-open the lock by applying forces in various directions, i.e. other than the original movement direction of the opening of the door. This is a unique feature that is absent from known locks, which although somewhat resistant to forces applied in the direction of the opening of the door due to the flat-surface bottom of the pinion head, are completely vulnerable when exposed to a force that is applied in any direction other than the original movement direction of the opening of the door, due to moment forces applied thereon.

It should be noted by the skilled artisan that the shape and size of the lock of the invention may vary according to need and desire. For instance, when assembling the lock on a truck, the lock may be larger in size compared to one used for a small van. In addition, the shape of the lock and/or its components may vary and may be square, rectangular, round, etc.

The invention claimed is:

1. A lock for doors, the lock comprising:

a) a clip intended to be mounted on a first structure, the clip comprising:
   an anchoring base; and
   a pinion having a round balled tip, and b) a lock-body intended to be mounted on a second structure, the lock-body comprising:
   left and right locking jaws having a proximal end and distal end, said proximal end of both jaws comprise grooves designed to embrace said round balled tip of the pinion from two different directions: vertically and horizontally to the direction of the movement of the door;
   a single retaining spring located in between the distal ends of said left and right locking jaws and designed to push the proximal end of said locking jaws against one another;
   a retractable bolt located in between the distal end of said locking jaws; and
   a trigger having an open- and closed-position, such that: (i) in the open-position, the trigger prevents said retractable bolt from entering in between the distal end of said locking jaws and thereby enabling the jaws to open and embrace said pinion when closing the door; and (ii) in the closed-position, when said pinion is embraced by said jaws, the trigger allows said retractable bolt to enter in between the distal end of said locking jaws and prevent opening of said locking jaws, wherein said first and second structures are intended to be locked relative to each other by said lock.

2. The lock of claim 1, wherein said anchoring base is designed to be secured in place to the door itself or to a wall/window-frame/automobile-frame and hold said pinion while preventing its movement of the pinion.

3. The lock of claim 1, wherein said lock-body further comprises: (i) a locking cylinder associated with a respective actuation key; and/or (ii) a solenoid, and said bolt is associated with either one or both.

4. The lock of claim 1, wherein said left and right locking jaws completely engulf/embrace said round balled tip of the pinion.

5. The lock of claim 1, wherein said trigger comprises an inner handle pressable by said pinion to enable said trigger to move from open- and closed-positions, and vise-versa.

6. The lock of claim 1, having (i) an open-state, in which said trigger is in an open-position that holds said bolt back thus allowing at least one of said left and right locking jaws to depart to allow either releasing said pinion engulfed therebetween or to engulf said pinion as said locking jaws and said pinion are pushed one against the other; and (ii) a closed-state, in which after said pinion is engulfed by said locking jaws, said trigger is in a its closed-position that enables said bolt to enter in between the distal end of said locking jaws and thus prevent said proximal end of the locking jaws from moving apart and releasing said pinion engulfed therebetween.

7. The lock of claim 1, wherein when said pinion is not in between said locking jaws, said trigger is in an open-position thus pressing said bolt back to prevent locking the two locking jaws together.

8. The lock of claim 1, wherein when in a locked position, pulling forces applied thereon do not affect the bolt and trigger.

9. The lock of claim 1, further comprising an emergency opening cable.

10. The lock of claim 1, which fits both a sliding door and a revolving door.

* * * * *